US006283564B1

(12) United States Patent
Corson

(10) Patent No.: US 6,283,564 B1
(45) Date of Patent: Sep. 4, 2001

(54) PORTABLE, WOODEN COMPUTER DESK

(75) Inventor: Sandra Corson, 12 Lowe St., Madison, ME (US) 04950

(73) Assignee: Sandra Corson, Madison, ME (US)

( * ) Notice: Subject to any disclaimer, the term of this patent is extended or adjusted under 35 U.S.C. 154(b) by 0 days.

(21) Appl. No.: 09/225,421

(22) Filed: Jan. 5, 1999

(51) Int. Cl.[7] ..... A47B 97/00

(52) U.S. Cl. ..... 312/223.2; 312/107; 312/194; 312/195; 312/196; 312/223.6

(58) Field of Search ..... 312/223.3, 223.6, 312/194, 195, 196, 198, 257.1, 265.5, 265.6, 107, 108, 238; 108/50.01, 50.02, 180, 153.1

(56) References Cited

U.S. PATENT DOCUMENTS

| | | | | |
|---|---|---|---|---|
| 3,533,362 | * | 10/1970 | Thompson et al. | 312/195 X |
| 4,153,311 | * | 5/1979 | Takahashi | 312/107 |
| 4,313,112 | | 1/1982 | Foster | 340/700 |
| 4,345,803 | * | 8/1982 | Heck | 312/223.3 X |
| 4,469,382 | * | 9/1984 | Slaats et al. | 312/194 X |
| 4,565,413 | | 1/1986 | Wallace | 312/184 |
| 4,626,048 | * | 12/1986 | Goodlander | 312/223.3 |
| 4,635,893 | | 1/1987 | Nelson | 248/558 |
| 4,681,378 | * | 7/1987 | Hellman, III | 312/107 X |
| 4,717,112 | | 1/1988 | Pirkle | 248/639 |
| 4,830,328 | | 5/1989 | Takach, Jr. et al. | 248/639 |
| 4,936,228 | * | 6/1990 | Capo-Bianco | 312/196 X |
| 5,020,449 | * | 6/1991 | Forte | 312/194 X |
| 5,024,167 | * | 6/1991 | Hayward | 312/195 X |
| 5,104,086 | | 4/1992 | Ramey, III et al. | 248/442.2 |
| 5,121,974 | * | 6/1992 | Monson | 312/194 |
| 5,130,494 | * | 7/1992 | Somonton et al. | 312/195 X |
| 5,255,966 | * | 10/1993 | Newhouse et al. | 312/107 |
| 5,419,525 | | 5/1995 | Hilton | 248/371 |
| 5,437,235 | * | 8/1995 | Randolph | 312/196 X |
| 5,447,215 | | 9/1995 | Volkmar et al. | 190/11 |
| 5,628,255 | * | 5/1997 | Neuner | 312/223.3 X |
| 5,697,686 | * | 12/1997 | Miller et al. | 312/194 |
| 5,715,761 | * | 2/1998 | Frattini | 312/223.6 X |

* cited by examiner

*Primary Examiner*—Peter M. Cuomo
*Assistant Examiner*—Rodney B. White

(57) ABSTRACT

A portable, wooden computer desk is disclosed, comprising an all wood computer desk that can be quickly and easily assembled without the use of tools or separate fastening devices. A continuous feed paper slot is provided to facilitate use of continuous feed paper. Holes are provided on the work surface for use of lamps and similar electric appliances. Electric cord indentations provide a way to place the present invention against a wall without damaging the electric cords of computer components.

9 Claims, 6 Drawing Sheets

PORTABLE, WOODEN COMPUTER DESK

RELATED APPLICATIONS AND DISCLOSURES

The present invention was first disclosed in the Disclosure Document filed on Jul. 9, 1998. There have been no previously filed, nor any co-pending applications, anywhere in the world.

BACKGROUND OF THE INVENTION

1. Field of the Invention

The present invention relates generally to computer desks, and, more particularly, to a portable, wooden computer desk.

2. Description of the Related Art

Personal computers have become a mainstay both at the home and in the business world. In fact, in the not too distant future a household that does not own a personal computer will be the exception rather than the norm.

As the personal computer has developed, a variety of peripheral business activities have been born as offspring of the information age. Among these areas, there is a substantial market for office furniture that is specially designed to accommodate computer equipment.

While these pieces do make special accommodations for storing the computer, monitor and keyboard as well as the special cabling that is required of such systems, they often suffer from the fact that they are large, bulky, difficult to transport and even more difficult to assemble, often requiring several hours and a variety of tools to complete the task. While this is not so great an inconvenience to the homeowner or office person where the unit need be assembled only once and most likely will remain in place for several years, to college students and others that move often, it is a nightmare. Accordingly, there is a need for a desk on which a personal computer can be stored and used that is small, portable and easy to assemble.

In the related art, several patents disclose computer desks with multiple shelves. These include U.S. Pat. No. 5,447,215, issued in the name of Volkmar et. al. and U.S. Pat. No. 4,565,413, issued in the name of Wallace Several patents disclose an adjustable computer work station and assembly. These include U.S. Pat. No. 5,419,525, issued in the name of Hilton, U.S. Pat. No. 5,104,086, issued in the name of Ramey III et. al., U.S. Pat. No. 4,830,328, issued in the name of Takach, Jr. et. al., U.S. Pat. No. 4,717,112, issued in the name of Pinkle, U.S. Pat. No. 4,635,893, issued in the name of Nelson and U.S. Pat. No. 4,313,112, issued in the name of Foster.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved portable, wooden computer desk that is easy to assembly without the use of tools.

Briefly described according to one embodiment of the present invention, a portable, wooden computer desk is disclosed, designed to provide the user with a convenient means by which to place and use a personal computer. The present invention comprises a desk constructed entirely of wood. The desk consists of a work surface, of a generally flat, L-shaped, curved configuration. The work surface has a sufficient cross sectional area to provide space for numerous computer components, such as a printer, CPU, monitor and keyboard.

A plurality of holes is located on the work surface, to facilitate insertion and passage of an electric cord of a lamp or other electric appliance therethrough.

A plurality of electric cord indentations, of a generally semicircular configuration, formed from the work surface, are located along the posterior edges of the work surface, extending inward from the posterior edges.

It is envisioned that there is at least one continuous feed paper slot, of a generally rectangular conjuration, formed from the work surface, extending inward from the posterior edge of the work surface.

The work surface has a plurality of milled assembly slots, of a generally linearly elongated, rectangular configuration, extending inward from the edges of work surface of the desk, from which each assembly slot is formed. Each milled assembly slot forms a plane perpendicular to the edge of the desk from which it is extends inward.

A plurality of legs, of a generally flat, rectangular configuration, extend downward from the work surface. The number of legs corresponds to the number of milled assembly slots on the work surface. Each leg has a milled assembly slot located at one end of the leg, running perpendicular to the elongated centerline of the leg.

The two exterior sets of the legs also function as side walls for a plurality of vertically spaced, horizontally positioned shelves. Each shelf has milled assembly slots which permit releasable attachment to the set of legs.

As such, fastening of all of the various components of the present invention is accomplished via the milled assembly slots in each component. Components that are connected together possess corresponding milled assembly slot. The user simply inserts each assembly slotted component into its corresponding assembly slot on the adjacent component, and the desk is fully assembled in a matter of minutes.

It is envisioned that the present invention would be available in kit form. The kit would include the work surface with milled assembly slots, three sets of legs (for a total of six legs), with milled assembly slots, with two sets of the legs also designed to support two shelves, which possess milled assembly slots.

It is another object of the present invention to provide a computer desk that lays flat during disassembled transport.

It is another object of the present invention to provide a computer desk that utilizes no separate fastening means.

It is another object of the present invention to provide a computer desk that has a large work surface area.

Other objects of the present invention include providing a device that is lightweight, durable and strong in construction, easy to manufacture and cost effective to manufacture.

DESCRIPTIVE KEY

| | |
|---|---|
| 10 portable, wooden computer desk | 85 paper |
| 20 desk | 90 milled assembly slot |
| 30 work surface | 100 leg |
| 35 computer component | 105 upper shelf |
| 40 hole | 107 upper shelf milled assembly slot |
| 50 electric cord | 110 lower shelf |

-continued

| | |
|---|---|
| 60 electric appliance | 120 lower shelf milled assembly slot |
| 70 electric cord indentation | |
| 80 continuous feed paper slot | |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 8.

1. Detailed Description of the Figures

Figure 1:
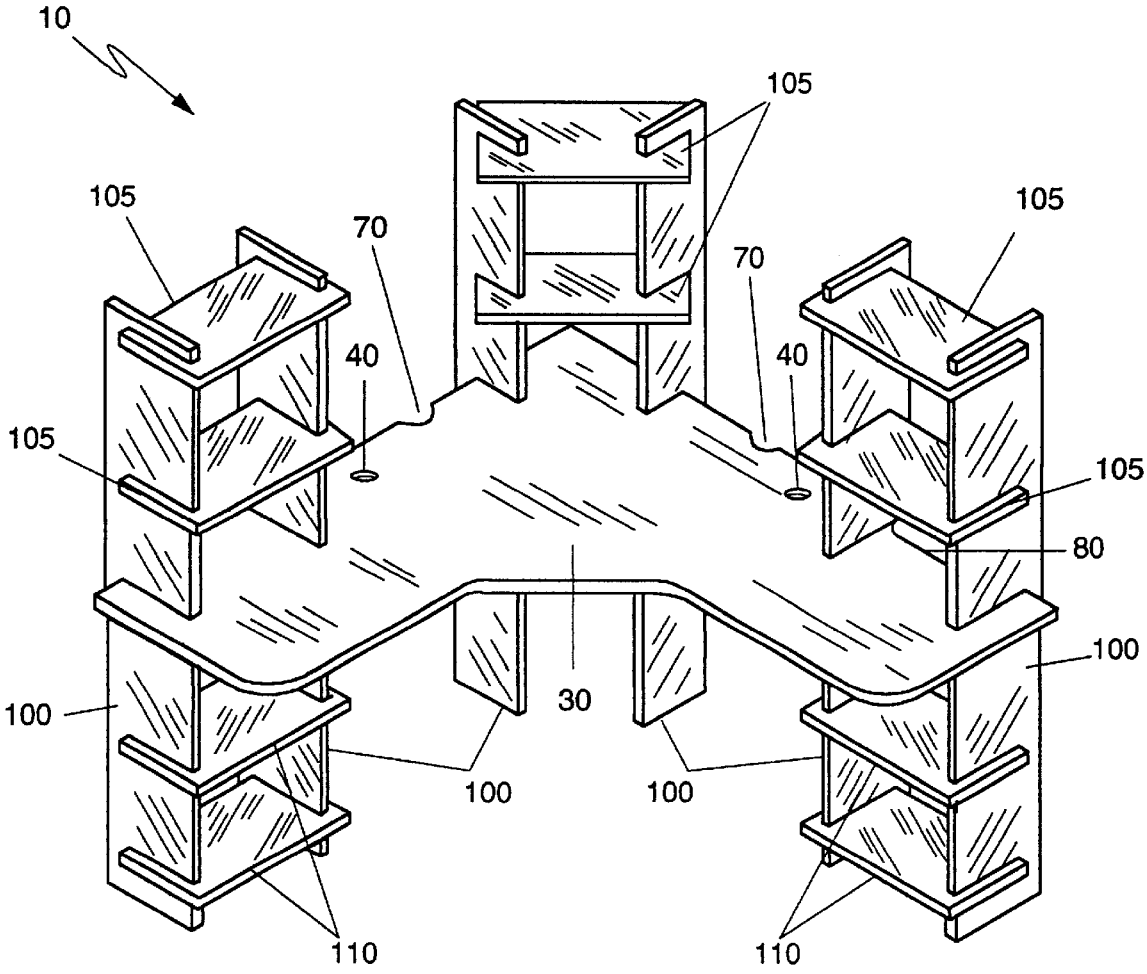
FIG. 1 is a front elevational view of the preferred embodiment of portable, wooden computer desk 10.

Referring now to FIG. 1, a portable, wooden computer desk 10 is shown, according to the present invention, designed to provide the user with a convenient means by which to place and use a personal computer. The present invention comprises a desk 20 constructed entirely of wood.

Figure 2:
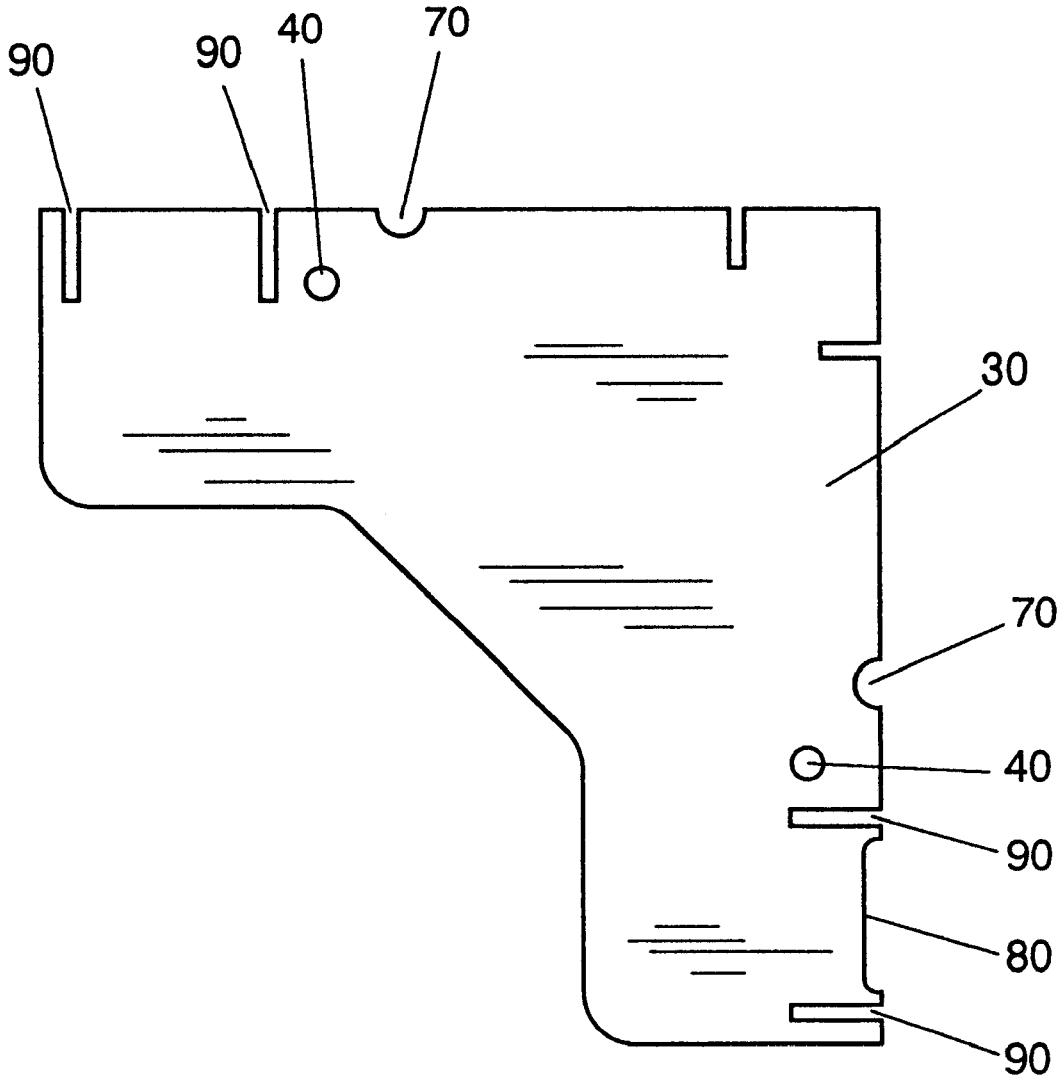
FIG. 2 is a top view of the work surface.

Referring now to FIGS. 1 and 2, the desk 20 consists of a work surface 30, of a generally flat, L-shaped, curved configuration.

Figure 3:
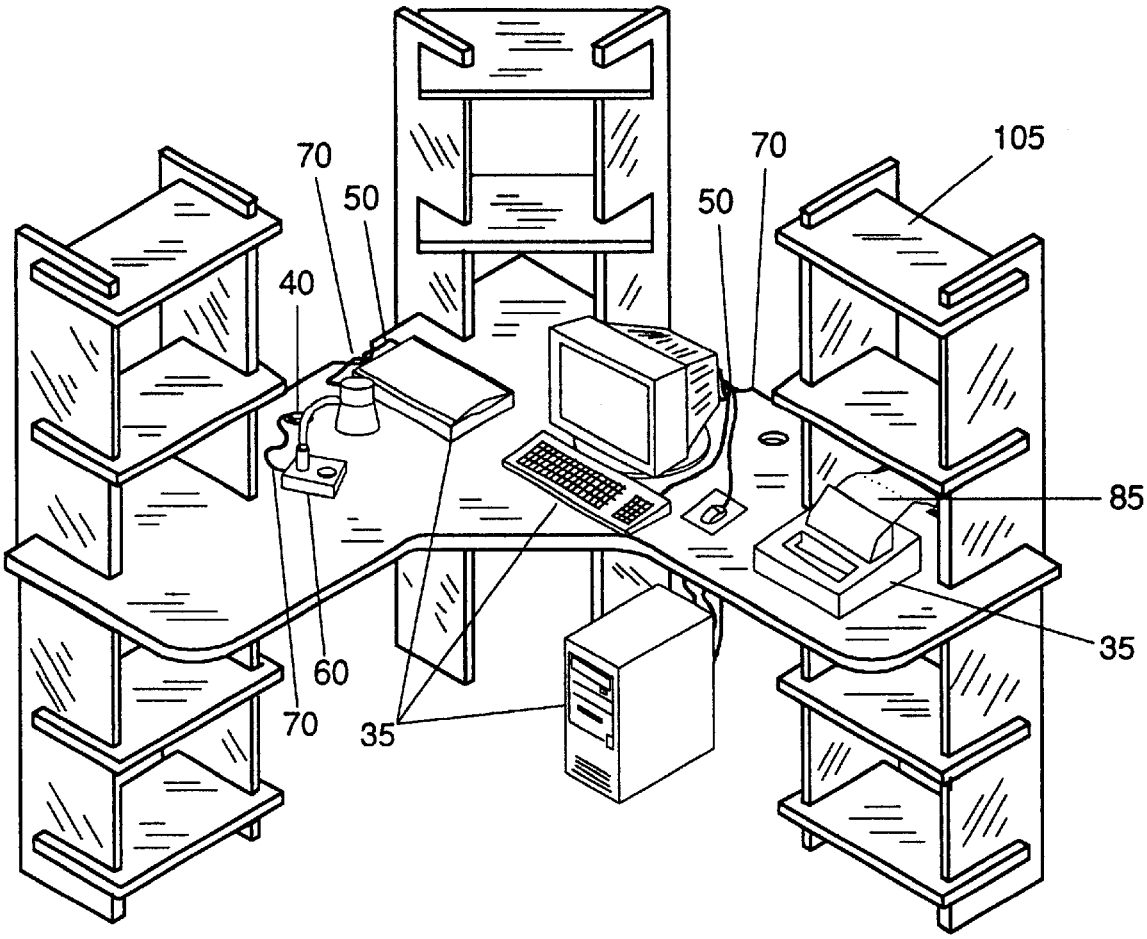
FIG. 3 is a perspective view shown with computer components.

Referring now to FIGS. 1, 2 and 3, the work surface 30 has a sufficient cross sectional area to provide space for numerous computer components 35, such as a printer, CPU, monitor and keyboard.

Referring now to FIG. 2, a plurality of holes 40 are located on the work surface 30, to facilitate insertion and passage of an electric cord 50 of a lamp 60 or similar electric appliance 60 therethrough, so that the electric cord 50 is out of sight of the casual observer.

Referring now to FIGS. 1, 2, 3 and 4, a plurality of electric cord indentations 70, of a generally semi-circular configuration, formed from the work surface 30, are located along the posterior edges of the work surface 30, extending inward from the posterior edges. The electric cord indentations 70 are designed to and are of a sufficient cross sectional area to permit the electric cords 50 of various computer components 35, such as a printer, CPU, monitor, keyboard and the like, to fit through the electric cord indentations 70, thus allowing the work surface 30 to be placed directly against a wall, without damaging the various electric cords 50 with the work surface 30.

It is envisioned that there is at least one continuous feed paper slot 80, of a generally rectangular configuration, formed from the work surface 30, extending inward from the posterior edge of the work surface 30. The continuous feed paper slot 80 has an elongated centerline parallel to the posterior edge of the work surface 30 from which it extends inward from. The continuous feed paper slot 80 is of sufficient size to allow paper 85 to feed from a supply of paper 85 located beneath the work surface 30 into a printer 35 located on the work surface 30, anterior to the continuous feed paper slot 80.

Figure 4:
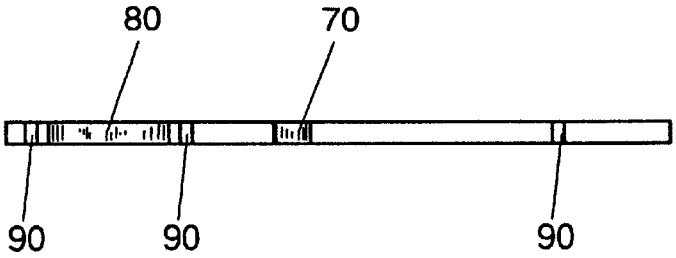
FIG. 4 is a rear view of the work surface.

Referring now to FIGS. 1, 2 and 4, the work surface 30 has a plurality of milled assembly slots 90, of a generally linearly elongated, rectangular configuration, extending inward from the edges of work surface 30 of the desk 20, from which each milled assembly slot 90 is formed. Each milled assembly slot 90 forms a plane perpendicular to the edge of the desk 20 from which it is extends inward.

Referring now to FIGS. 1 and 3, a plurality of legs 100, of a generally flat, rectangular configuration, extend downward from the work surface 30. The number of legs 100 corresponds to the number of milled assembly slots 90 on the work surface 30. Each leg 100 has a milled assembly slot 90 located at one end of the leg 100, running perpendicular to the elongated centerline of the leg 100. For purposes of disclosure, three sets of legs 100 are depicted connecting to the posterior of the work surface 30.

Each leg 100 extends upward vertically above the work surface 30, and forms the lateral supports for a plurality of upper shelves 105, each upper shelf 105 being of a flat, rectangular configuration with milled assembly slots 90. Each leg 100 possesses at least one upper shelf milled assembly slot 107 into which an upper shelf 105 is releasably connected.

Figure 5A:
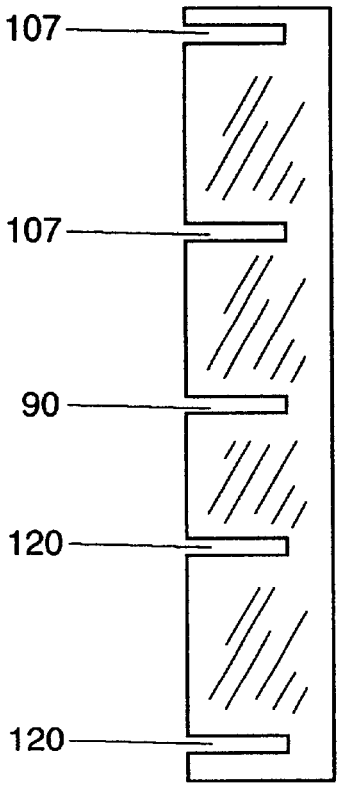
FIG. 5*a* is a side view of a leg used to support a shelf.
Figure 5B:
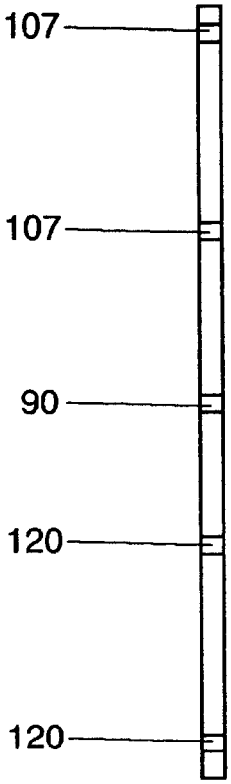
FIG. 5*b* is a front view thereof.

Referring now to FIGS. 5*a* and 5*b*, the two exterior sets of legs 100 also function as side walls for a plurality of vertically spaced lower shelves 110. These legs 100 also possess lower shelf milled assembly slots 120 to permit releasably attachment of the lower shelves 110 to the legs 100.

Figure 6:
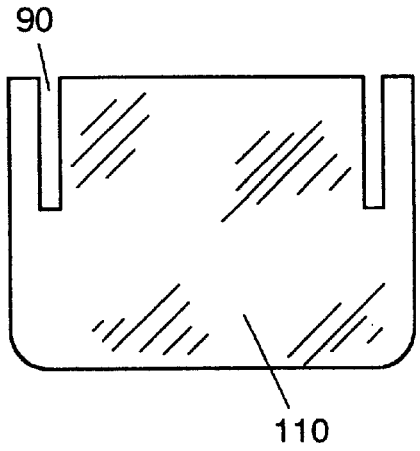
FIG. 6 is a top view of a shelf.

Referring now to FIG. 6, each lower shelf 110 has milled assembly slots 90 which permit releasable attachment to the set of legs 100. Each lower shelf 110 is of sufficient cross sectional diameter so as to be capable of holding a box of computer paper 80.

Figure 7A:
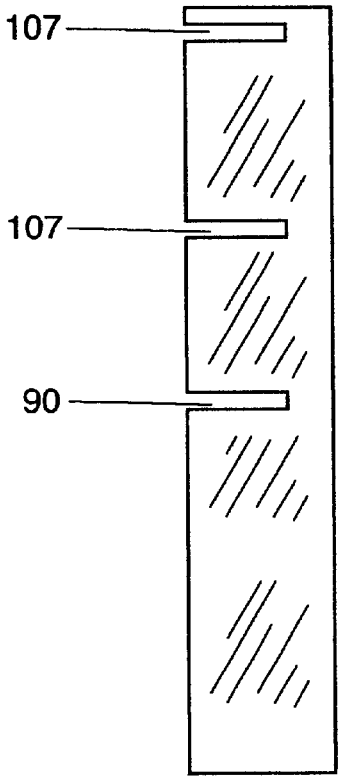
FIG. 7*a* is a side view of a leg positioned in the central portion of the present invention.
Figure 7B:
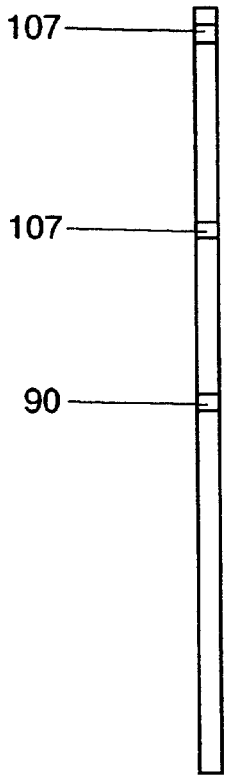
FIG. 7*b* is a front view thereof.

FIGS. 7*a* and 7*b* depict the centrally located legs 100 which do not act as supports for lower shelves 110.

Figure 8:
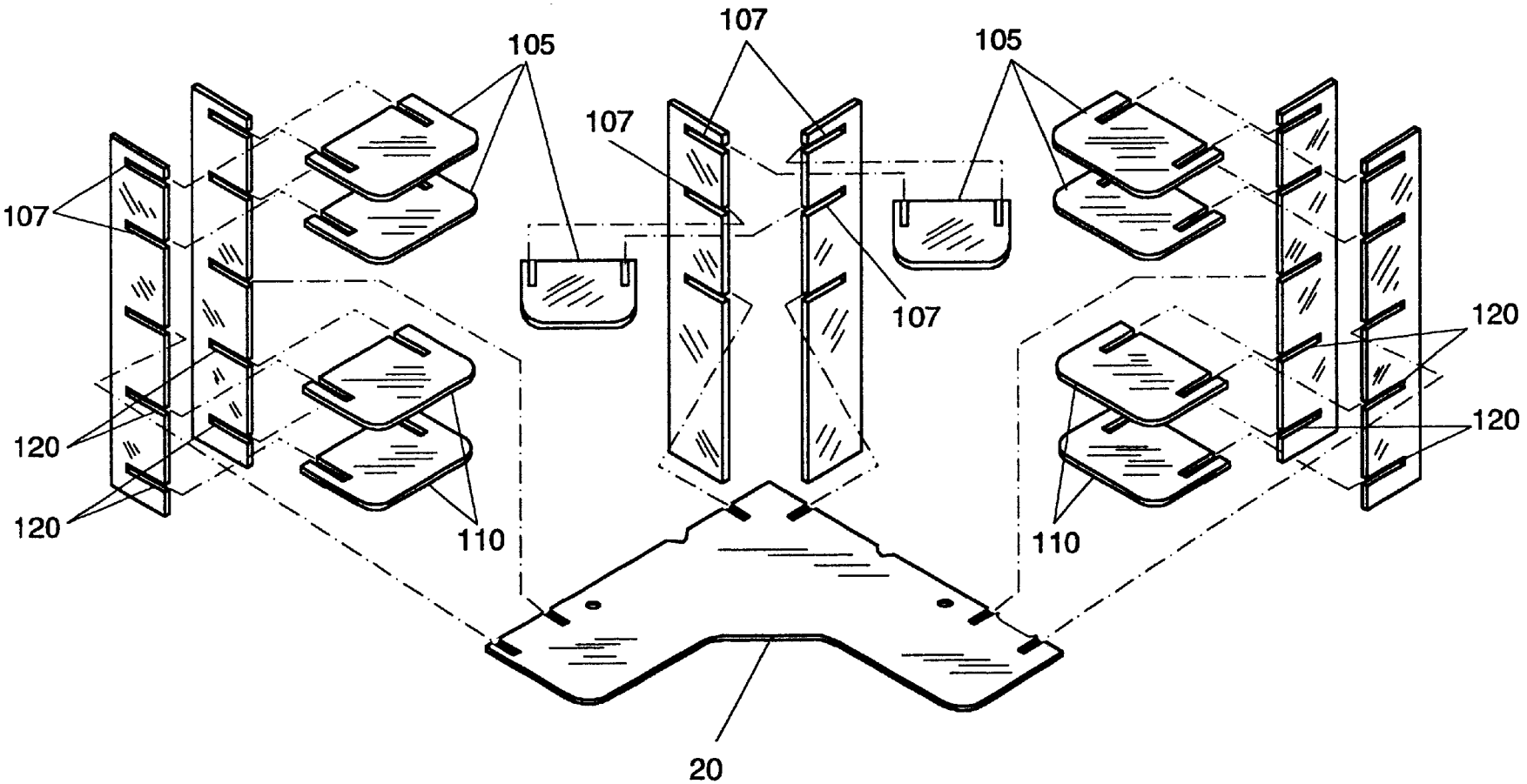
FIG. 8 is an exploded view of the preferred embodiment of the present invention.

Referring now to FIGS. 3 and 8, as such, fastening of all of the various components of the present invention is accomplished via the milled assembly slots 90 in each component. Components that are connected together possess corresponding milled assembly slot 90. The user simply inserts each assembly slotted component into its corresponding milled assembly slot 90 on the adjacent component, and the desk 20 is fully assembled in a matter of minutes. The width and depth of each milled assembly slot 90 permits the various components to slide together into proper position relative to each other to form an aesthetically pleasing desk 20. Disassembly is just as simple and is accomplished by removing the components from the milled assembly slots 90.

It is envisioned that the present invention would be available in kit form. The kit would include the work surface with milled assembly slots 90. Three sets of legs 100 (for a total of six legs 100), with milled assembly slots 90 are also included in the kit. Two sets of these legs 100 are also designed to support two lower shelves 110, which possess milled assembly slots 90. All legs 100 have upper shelf milled assembly slots 107 to support upper shelves 105. Three upper shelves 105 with milled assembly slots 90 are also included.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, simply unpack the components of the present invention, attach the legs 100 with the shelf 110 milled assembly slots 90 to the shelf 110 milled assembly slots 90 on the outer portions of the work surface 30. Attach the remaining two legs 100 to the centrally located milled assembly slots 90 on the work surface 30 by using the corresponding milled assembly slots 90. The lower shelves 110 are then attached to the exterior located legs 100 by sliding the lower shelf milled assembly slots 120 on the legs 100 and lower shelves 110 together. The upper shelves 105 are then attached to all legs 100 by sliding the milled assembly slots 90 on the upper shelves 105 into the upper shelf milled assembly slots 107 on the legs 100. Computer components 35 are then placed on the work surface 30, with their electric cords placed in the electric cord indentations 70. A lamp electric cord 50 or other electric cords 50 from electric appliances 60 may be placed through the hole 40 on the work surface 30. Paper 85 may be placed under the work surface 30 and fed upward, through the continuous feed paper slot 80, to a printer 35, located anterior to the continuous feed paper slot 80.

The foregoing description is included to illustrate the operation of the preferred embodiment and is not meant to limit the scope of the invention. The scope of the invention is to be limited only by the following claims.

What is claimed is:

1. A portable, wooden computer desk is disclosed comprising:

a work surface, of a generally L-Shaped configuration and having a posterior edge, said work surface having milled assembly slots, formed from said work surface;

a plurality of lower shelves, said lower shelves each containing two milled assembly slots;

a plurality of upper shelves, each said upper shelf containing two milled assembly slots;

a plurality of sets of legs, each said leg having at least one upper shelf milled assembly slot to hold at least one upper shelf, a milled assembly slot to connect to said work surface, and at least one lower shelf milled assembly slots, designed to support at least one lower shelf;

at least one set of legs, each leg having a milled assembly slot to connect to said work surface, and at least one lower shelf milled assembly slot, designed to support at least one lower shelf;

at least two holes, said holes formed from and located on said work surface, and designed to facilitate insertion and passage of an electric cord of a lamp or other electric appliance there through, so that said electric cord is out of sight of the casual observer;

at least one electric cord indentation, of a generally semicircular configuration, formed from said work surface, said electric cord indentations located along the posterior edge of said work surface, extending inward from said posterior edge; and at least one continuous feed paper slot, of a generally rectangular configuration, formed from said work surface, extending inward from said posterior edge of said work surface.

2. The portable, wooden computer desk described in claim 1, wherein fastening of said upper shelves, said work surface, and said lower shelves to said legs respectively is accomplished via said milled assembly slots in each component, with components that are connected together possessing corresponding milled assembly slots.

3. A portable, wooden computer desk kit comprising:

a work surface with milled assembly slots, two electric cord indentations, one continuous feed paper slot, and two holes;

four lower shelves, said lower shelves each containing two milled assembly slots;

three upper shelves, each said upper shelf containing two milled assembly slots;

two sets of legs having a total of four legs, each said leg having two upper shelf milled assembly slots to hold two upper shelves, a milled assembly slot to connect to said work surface, and two lower shelf milled assembly slots, designed to support two lower shelves; and one set of legs, each leg having a milled assembly slot to connect to said work surface, and two lower shelf milled assembly slots, designed to support two lower shelves.

4. The portable, wooden computer desk kit of claim 3, wherein all said work surface, legs and upper shelves and lower shelves are constructed of wood.

5. A kit for forming a portable, wooden computer desk of the type described in claim 1, wherein said kit comprises:

a work surface with milled assembly slots, said work surface having at least one electric cord indentation, at least one continuous feed paper slot, and at least one hole;

a plurality of lower shelves, said lower shelves each containing two milled assembly slots;

a plurality of upper shelves, each said upper shelf containing two milled assembly slots;

a plurality of sets of legs, each said leg having at least one upper shelf milled assembly slots to hold at least one upper shelf, a milled assembly slot to connect to said work surface, and at least one lower shelf milled assembly slots, designed to support at least one lower shelf; and at least one set of legs, each leg having a milled assembly slot to connect to said work surface, and at least one lower shelf milled assembly slot, designed to support at least one lower shelf.

6. The portable, wooden computer desk kit of claim 5, wherein all said work surface, legs and upper shelves and lower shelves are constructed of wood.

7. A portable, wooden computer desk comprising:

a work surface of a generally flat, L-shaped, curved configuration, said work surface forming at least one hole penetrating therethrough to facilitate insertion and passage of a electrical cabling;

at least one indentation of a generally semi-circular configuration, formed from the work surface and located along a posterior edge of the work surface and extending inward from said posterior edge;

at least one slot of a generally rectangular configuration formed from and penetrating through said work surface and extending inward from said posterior edge of said work surface, said slot having an elongated centerline parallel to the posterior edge of the work surface;

a plurality of milled assembly slots, each of a generally linearly elongated, rectangular configuration, formed in said work surface and extending inward from the perimeter of said work surface in a plane perpendicular to any perimeter edge of said work surface from which it extends; and a plurality of sets of legs, each of a generally flat, rectangular configuration, for frictionally fitting within a said milled assembly slot and extending downward from said work surface.

8. The portable, wooden computer desk of claim 7, wherein each said leg extends upward vertically above the work surface, each leg forming at least one upper shelf milled assembly slot, said desk further comprising:

at least one upper shelf, each said upper shelf being of a flat, rectangular configuration with milled assembly slots into which said leg is releasably affixed thereby forming a lateral support thereof.

9. The portable, wooden computer desk of claim 7, wherein each said leg extends downward vertically below the work surface, each leg forming at least one lower shelf milled assembly slot, said desk further comprising:

at least one lower shelf, each said lower shelf being of a flat, rectangular configuration with milled assembly slots into which said leg is releasably affixed thereby forming a lateral support thereof.

* * * * *